United States Patent [19]

Fukui et al.

[11] Patent Number: 4,724,092

[45] Date of Patent: Feb. 9, 1988

[54] FLUORINE-CONTAINING GREASE COMPOSITION

[75] Inventors: Shoshin Fukui, Osaka; Shuhei Shimasaki, Hyogo; Takashi Tohzuka, Osaka, all of Japan

[73] Assignee: Daikin Industries Ltd., Osaka, Japan

[21] Appl. No.: 795,903

[22] Filed: Nov. 7, 1985

[30] Foreign Application Priority Data

Nov. 7, 1984 [JP] Japan ..... 59-235618

[51] Int. Cl.[4] ..... C10M 105/54; C10M 107/38

[52] U.S. Cl. ..... 252/54; 252/58; 568/681; 568/683; 568/684

[58] Field of Search ..... 252/58, 54; 568/681, 568/683, 684

[56] References Cited

U.S. PATENT DOCUMENTS

| | | | |
|---|---|---|---|
| 2,870,222 | 1/1959 | Gordon et al. | 252/54 |
| 3,293,306 | 12/1966 | Le Bleu et al. | 252/54 |
| 3,306,853 | 2/1967 | Fogg et al. | 252/58 |
| 3,345,424 | 10/1967 | Hauptschein et al. | 252/58 |
| 3,483,129 | 12/1969 | Dolle et al. | 252/54 |
| 3,505,229 | 4/1970 | Skehan | 252/54 |
| 3,536,624 | 10/1970 | Christian et al. | 252/54 |
| 3,715,378 | 2/1973 | Sianesi et al. | 252/54 |
| 3,909,431 | 9/1975 | Figiel | 252/54 |
| 4,324,673 | 4/1982 | Christian et al. | 252/58 |
| 4,443,349 | 4/1984 | Snyder, Jr. et al. | 252/54 |
| 4,451,646 | 5/1984 | Siansi et al. | 252/54 |
| 4,528,109 | 7/1985 | Fifolt | 252/58 |

FOREIGN PATENT DOCUMENTS

| | | | |
|---|---|---|---|
| 856239 | 11/1970 | Canada . | |
| 960396 | of 1974 | Canada | 525/529 |
| 0095825 | 1/1983 | European Pat. Off. . | |
| 2008652 | 1/1970 | France . | |
| 1251300 | 5/1969 | United Kingdom . | |

OTHER PUBLICATIONS

Skehan, English Translation of Japanese Patent Publication No. 45715/1974, published Dec. 5, 1974, "Fluorinated Polymer Composition".

Yonetani et al, English Translation of Japanese Patent Publication No. 18079/1964, published Aug. 27, 1964, "Fluorocarbon Grease Composition".

*Primary Examiner*—William R. Dixon, Jr.
*Assistant Examiner*—Ellen McAvoy
*Attorney, Agent, or Firm*—Birch, Stewart, Kolasch & Birch

[57] ABSTRACT

A fluorine-containing grease composition comprising a halogen-containing polyether of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2O)_f- \quad (I)$$

wherein a, b, c, d, e and f are each an integer not less than 0 and satisfy the following equations:

$$2 \leqq a+b+c+d+e+f \leqq 200$$

and, $$1 \leqq a+c+d+f$$

and 0.5 to 60% by weight of a fluororesin base on the weight of the whole composition, which has good chemical and heat resistance and is used in a high temperature environment.

17 Claims, No Drawings

FLUORINE-CONTAINING GREASE COMPOSITION

FIELD OF THE INVENTION

The present invention relates to a fluorine-containing grease composition. More particularly, it relates to a fluorine-containing grease composition comprising a fluorine-containing polyether as a base oil and a fluorine-containing resin.

BACKGROUND OF THE INVENTION

A grease composition comprising a lubricant oil and, as a thickening agent, fine powder of silica gel, aluminum hydroxide or ferric hydroxide dispersed in the oil is commercially available. Since the grease composition had such poor chemical resistance, it cannot be used as a grease for cocks of chemical equipment which contacts a corrosive gas such as $CF_3Br$, $Br_2$, $Cl_2$, $F_2$, HF and $ClF_3$. In addition, since its heat resistance is poor, it cannot be used in a high temperature environment.

To overcome these defects a grease composition comprising a low molecular weight polymer of trifluorochloroethylene, polyether having branched perfluoroalkyl groups and a fluororesin was proposed (cf. Japanese Patent Publication Nos. 18079/1964 and 45715/1974). Although the proposed grease composition has better chemical and heat resistance than the above describe it still had drawbacks such as the fluorine-containing base oil has high vapor pressure and tends to vaporize at a high temperature or in vacuo so that its application is limited.

SUMMARY OF THE INVENTION

One object of the present invention is to provide a grease composition having good chemical and heat resistance.

Another object of the present invention is to provide a grease composition having low vapor pressure so that it can work for a long time even at a high temperature and/or in vacuo.

Accordingly, the present invention provides a fluorine-containing grease composition comprising a halogen-containing polyether of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2O)_f- \quad (I)$$

wherein a, b, c, d, e and f are each an integer not less than 0 and satisfy the following equations:

$$2 \leq a+b+c+d+e+f \leq 200$$

and, $$1 \leq a+c+d+f$$

and 0.5 to 60% by weight of a fluororesin based on the weight of the whole composition.

In the formula (I), the sequence of the repeating units in the parentheses is arbitrary but not restricted to the above sequence.

The halogen-containing polyether (I) is a novel polymer and disclosed in U.S. patent application Ser. No. 684,345 filed on Dec. 20, 1984 and European Patent Application No. 84 116 003.9 filed on Dec. 20, 1984 (A2-Publication No. 0148482 published on July 17, 1985), the disclosures of which are hereby incorporated by reference.

Although the preparation of the polyether (I) is disclosed in detail in the above applications, it is briefly explained.

The polyether (I) wherein b, c, d, e and f are 0 (zero) and a is not 0 (zero) is prepared by ring opening polymerization of 2,2,3,3-tetrafluorooxetane preferably in the present of an initiator (e.g. halides of alkali metals or a compound having strong Lewis acidity).

The polyether (I) wherein at least one of b, c, d, e and f is not 0 (zero) is prepared by fluorinating and/or chlorinating the polyether (I) wherein b, c, d, e and f are 0 (zero) and a is not 0 (zero) produced in the above manner.

Since the polyether (I) used according to the present invention is a linear polymer, it has lower vapor pressure, better chemical and heat resistance and its viscosity is less affected by temperature change than a conventional branched halogen-containing polyether comprised of, for example, repeating units:

$$-(\overset{\overset{CF_3}{|}}{C}FCF_2O)_n-(CF_2O)_m-$$

or $$-(\overset{\overset{CF_3}{|}}{C}FCF_2O)_n,$$

or a polymer of the formula:

$$Cl(CF_2CFCl)_nCl$$

provided that the viscosities are the same.

The fluororesins used according to the present invention are solids. Examples of such are polytetrafluoroethylene, a copolymer of tetrafluoroethylene and a comonomer copolymerizable therewith (e.g. hexafluoropropylene, ethylene and vinyl ether having a fluoroalkyl group), polychlorotrifluoroethylene and a copolymer of chlorotrifluoroethylene and a comonomer copolymerizable therewith. The one preferred is polytetrafluoroethylene having a low molecular weight of 5,000 to 800,000, especially 10,000 to 500,000. The term "polytetrafluoroethylene" herein used includes not only a homopolymer of tetrafluoroethylene but also a copolymer of tetrafluoroethylene with up to and including 1% by weight of a modifier such as hexafluoropropylene, perfluoro(alkyl vinyl ether) and chlorotrifluoroethylene.

The smaller the particle size of the fluororesin, the better. When the particle size is 10 μm or less, the amount of the resin to be added can be reduced, and the prepared grease composition is smooth and has good distribution property.

The content of the fluororesin in the grease composition of the invention is from 0.5 to 60% by weight based on the weight of the whole composition. When the content is less than 0.5% by weight, the dropping point of the grease composition is too low and oil separation is too large to be used in a high temperature environment and further the viscosity of the composition greatly varies with temperature change. When the content is larger than 60% by weight, the grease composition becomes so hard that its preparation is difficult, its distribution property is deteriorated and it tends to solidify at a high temperature.

The grease composition can be prepared by a per se conventional method. For example, powdery fluororesin is added to the halogen-containing polyether (I) having a suitable viscosity and agitated or mixed by means of three-roll or kneader to prepare the grease composition. In another method, a dispersion of solid fluororesin in a suitable solvent such as trichlorotrifluoroethane is added to the halogen-containing polyether (I) and homogeneously mixed while removing the solvent under heating and/or evacuating.

In addition to the above two essential components, the grease composition of the invention may contain a hydrocarbon base or silicon compound base grease, and particularly a conventional halogen-containing grease.

The present invention will be explained in further detail by the following examples.

TABLE 1

| Example No. | Base oil (amount) | PTFE (g) | TFE/HFP copolymer (g) |
|---|---|---|---|
| 1 | $F(CF_2CF_2CF_2O)_nCF_2CF_3$ (Average of n = 28) (680 g) | 320 | — |
| 2 | $F(CCl_2CF_2CF_2O)_nCCl_2CF_3$ (Average of n = 12) (680 g) | — | 320 |
| 3 | $F(CH_2CF_2CF_2O)_nCH_2CF_3$ (Average of n = 7) (680 g) | 320 | — |
| Comp. 1 | $Cl(CF_2CFCl)_nCl$ (Average of n = 5.5) (680 g) | 320 | — |
| Comp. 2 | Synthetic oil (Paraffin type) (Viscosity at 98.89° C. = 9.8 cst.) (500 g) | — | 500 |

TABLE 2

| Example No. | Acid resistance | Alkali resistance | Non-miscible Viscosity | Evaporation amount (%) | Extreme-pressure limit load (lbs) |
|---|---|---|---|---|---|
| 1 | No change | No change | 300 | 1> | 1,500 |
| 2 | No change | No change | 290 | 1> | 2,200 |
| 3 | No change | No change | 300 | 1> | 1,800 |
| Comp. 1 | No change | No change | 300 | 56 | 2,500 |
| Comp. 2 | Decomposed | Decomposed | 280 | 4 | 1,200 |

EXAMPLES 1–4 AND COMPARATIVE EXAMPLES 1–2

To a base oil (680 g) shown in Table 1, fine powder of polytetrafluoroethylene (average particle size of 0.3 μm, average molecular weight of about 400,000) or a copolymer of 99.85% by mole of tetrafluoroethylene and 0.15% by mole of hexafluoropropylene (average particle size of 0.15 μm, average molecular weight of about 200,000) (320 g) was added and agitated in a kneader for 6 hours to obtain a grease composition. Its physical properties are measured as follows:

Acid Resistance

The grease composition is immersed in 35% by weight hydrochloric acid at a room temperature for 16 hours. Then, the change in appearance is observed.

Alkali Resistance

The grease composition is immersed in 10% by weight aqueous solution of sodium hydroxide at a room temperature for 16 hours. Then, the change in appearance is observed.

Non-miscible Viscosity

Measured according to the specification of JIS (Japanese Industrial Standards) K2560.

Evaporation Amount

The grease composition (0.25 g) is uniformly applied on a glass plate (26 mm×76 mm) and kept at 150° C. for 7 days. Then, the weight loss is measured.

Extreme-Pressure Limit Load

Measured by Falex tester.

The results are shown in Table 2.

EXAMPLE 4

To the same base oil (700 g) as used in Example 1, polytetrafluoroethylene (300 g, average particle size of 0.1 μm, average molecular weight of about 60,000) dispersed in trichlorotrifluoroethane (1,700 g) at a concentration of 15% by weight was added and agitated in a universal mixer for 8 hours under heating while removing the solvent by evacuation to obtain a grease composition.

EXAMPLE 5

To the same base oil (850 g) as used in Example 1, polytetrafluoroethylene (150 g, average particle size of 0.1 μm, average molecular weight of about 60,000) dispersed in trichlorotrifluoroethane (1,725 g) at a concentration of 15% by weight was added and agitated in a universal mixer for 8 hours under heating while removing the solvent by evacuation to obtain a grease composition.

What is claimed is:

1. A fluorine-containing grease composition comprising a halogen-containing linear polyether of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2O)_f- \quad (I)$$

wherein a, b, c, d, e and f are each 0 (zero) or an integer of at least 1 and satisfy the following equations:

$$2 \leq a+b+c+d+e+f \leq 200$$

and, $$1 \leq a+c+d+f$$

and 0.5 to 60% by weight of a fluororesin selected from the group consisting of polytetrafluoroethylene, a copolymer of tetrafluoroethylene and a comonomer copolymerizable therewith, polychlorotrifluoroethylene and a copolymer of chlorotrifluoroethylene and a comonomer copolymerizable therewith based on the weight of the composition.

2. A fluorine-containing grease composition according to claim 1, wherein b=c=d=e=f=0 (zero).

3. A fluorine-containing grease composition according to claim 1, wherein a=b=d=e=f=0 (zero).

4. A fluorine-containing grease composition according to claim 1, wherein the fluororesin is polytetrafluoroethylene or a tetrafluoroethylene/hexafluoropropylene copolymer.

5. A fluorine-containing grease composition according to claim 4, wherein the fluororesin is polytetrafluoroethylene having a molecular weight of 5,000 to 800,000.

6. A fluorine-containing grease composition according to claim 5, wherein the molecular weight is 10,000 to 500,000.

7. A fluorine-containing grease composition according to claim 1, wherein the fluororesin is in a powder form having a particle size of 10 μm or less.

8. A fluorine-containing grease composition comprising a halogen-containing linear polyether of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2O)_f- \quad (I)$$

wherein a, b, c, d, e and f are each 0 (zero) or an integer of at least 1 and satisfy the following equations:

$$2 \leqq a+b+c+d+e+f \leqq 200$$

and $$1 \leqq a+c+d+f$$

and 0.5 to 60% by weight of polytetrafluoroethylene having a molecular weight of 10,000 to 500,000 based on the weight of the whole composition, wherein the polytetrafluorethylene is in a powder form having a particle size of 10 μm or less.

9. A process for preparing a fluorine-containing grease composition which comprises adding a fluororesin-containing composition to a halogen-containing linear polyether of the formula:

$$-(CH_2CF_2CF_2O)_a-(CHClCF_2CF_2O)_b-(CCl_2CF_2CF_2O)_c-(CHFCF_2CF_2O)_d-(CFClCF_2CF_2O)_e-(CF_2CF_2CF_2O)_f- \quad (I)$$

wherein a, b, c, d, e and f are each 0 (zero) or an integer of at least 1 and satisfy the following equations:

$$2 \leqq a+b+c+d+e+f \leqq 200$$

and $$1 \leqq a+c+d+f$$

whereby a mixture is formed and agitating said mixture, the amount of fluororesin added being 0.5 to 60% by weight based on the weight of the said fluorine-containing grease composition, wherein the fluororesin is selected from the group consisting of polytetrafluoroethylene, a copolymer of tetrafluoroethylene and a comonomer copolymerizable therewith, polychlorotrifluoroethylene and a copolymer of chlorotrifluoroethylene and a comonomer copolymerizable therewith.

10. A process according to claim 9, whereby the fluororesin containing composition is a dispersion of fluororesin in a trichlorotrifluoroethane solvent.

11. A process according to claim 9, wherein the fluororesin is polytetrafluoroethylene having a molecular weight of 5,000 to 800,000.

12. A process according to claim 10, wherein the fluororesin is polytetrafluoroethylene having a molecular weight of 5,000 to 800,000.

13. A process according to claim 11, wherein the molecular weight is 10,000 to 500,000.

14. A process according to claim 12, wherein the molecular weight is 10,000 to 500,000.

15. A process according to claim 9, wherein the fluororesin is in a powder form having a particle size of 10 μm or less.

16. A process according to claim 13, wherein the polytetrafluoroethylene is in a powder form having a particle size of 10 μm or less.

17. A process according to claim 14, wherein the polytetrafluoroethylene of the dispersion is in a powder form having a particle size of 10 μm or less.

* * * * *